US006151719A

United States Patent [19]

Poole

[11] Patent Number: 6,151,719

[45] Date of Patent: Nov. 28, 2000

[54] FOOTBALL HELMET INCORPORATING A RAIN GUARD

[76] Inventor: Greg Poole, 211 Virginia La., Conroe, Tex. 77304

[21] Appl. No.: 09/437,822

[22] Filed: Nov. 10, 1999

[51] Int. Cl.[7] ..... A42B 3/04

[52] U.S. Cl. ..... 2/425; 2/422; 2/424; 2/DIG. 5

[58] Field of Search ..... 2/9, 424, 425, 2/422, DIG. 5

[56] References Cited

U.S. PATENT DOCUMENTS

| | | | |
|---|---|---|---|
| 3,166,761 | 1/1965 | Strohm | 2/424 |
| 4,587,677 | 5/1986 | Clement | 2/424 |
| 5,832,541 | 11/1998 | Rock | 2/424 |
| 5,978,973 | 11/1999 | Chartrand | 2/422 |

*Primary Examiner*—Michael A. Neas
*Attorney, Agent, or Firm*—Rosenthal & Osha LLP

[57] ABSTRACT

A rain guard is attached to the top front of a football helmet or facemask and is shaped to divert rain or other like moisture away from the wearer's face.

4 Claims, 2 Drawing Sheets

FOOTBALL HELMET INCORPORATING A RAIN GUARD

CROSS-REFERENCE TO RELATED APPLICATIONS

Not applicable.

1. Background—Field of Invention

This invention relates to football helmets, specifically dealing with an attachment which diverts water flowing off of the helmet away from the wearers face.

2. Background—Description of Prior Art

Football helmets have continually evolved since the beginning of the game to more safely protect the player. Helmets have transitioned from leather to plastic to plastic with a facemask. These facemasks have had the express purpose of protecting the wearer from trauma to the face but they serve no function to protect the wearer from impaired vision as a result of rain. U.S. Pat. No. 4,086,664 to Humphrey (1978) is a face guard connected to the forward side of the helmet but it is of little or no use in diverting rain away from the wearer's face. Rain, in fact, is channeled via the attachment connections towards the wearer's face. There have been numerous attempts to produce a safer facemask by seeking to reduce tackling by grabbing of the facemask. U.S. Pat. No. 4,271,537 to Bowlus (1981) allows for the removal of the facemask as a result of extreme force to prevent bodily injury resulting from a tackle made by grasping the facemask. U.S. Pat. No. 4,594,737 to Butash (1986) calls for a facemask strung with beads to inhibit opposing player's ability to grab the facemask. Again, however, these attachments and renditions serve no direct or indirect purpose of diverting rain away from the wearer's face.

Traditional facemasks protect the wearer from direct trauma but serve little protection from intruding fingers or other small objects. This has resulted in football helmets with shields in place of or placed over facemasks. These shields have limited value in improving wearer visibility during a rainy game. U.S. Pat. No. 5,479,658 to Harris (1994) is a protective shield placed over the facemask but there is no provision for controlling water seeping behind the shield. Vision could also be hampered by water beading on the shield much as it does on a windshield without the benefit of windshield wipers.

There are few football helmet attachments that are for the express purpose of protecting the wearer from the elements. U.S. Pat. No. 5,832,541 to Rock (1997) is a turf guard that fits the top of the facemask but its purpose is to eliminate foreign matter from lodging within the facemask, not diverting rain away from the face of the wearer. U.S Pat. No. 4,599,752 to Mitchell (1986) calls for a helmet cover for cosmetic purposes and U.S. Pat. No. 4,937,888 to Straus (1990) calls for a helmet cover for protective purposes but neither does anything to enhance the wearers vision during a rainy game.

SUMMARY

The present invention consists of a water guard attached to the front of a football helmet so that water coming off of a helmet in a rainstorm or other moisture-producing storm is diverted away from the wearer's face.

OBJECTS AND ADVANTAGES

Accordingly, besides the objects and advantages of the helmet rain-guard described in my above patent, several objects and advantages of the present invention are:

(a) to provide a football helmet attachment that provides for a safer helmet while requiring minimal modifications or changes in the helmet (b) to provide a football helmet attachment that can be clear or of a color that coordinates with the helmet or school colors.

(c) to provide a football helmet attachment that produces a safer helmet while adding minimal additional weight.

(d) to provide a football helmet attachment that produces a safer helmet at minimal additional cost to the manufacturer.

(e) to provide a football helmet attachment that provides for clearer vision for the wearer in a sport in which impaired vision is a detriment to performance.

Further objects and advantages are to provide a Football helmet attachment that is convenient to remove or replace, which is simple to use and inexpensive to manufacture. Still further objects and advantages will become apparent from a consideration of the ensuing description and drawings.

DESCRIPTION

Figure 1:
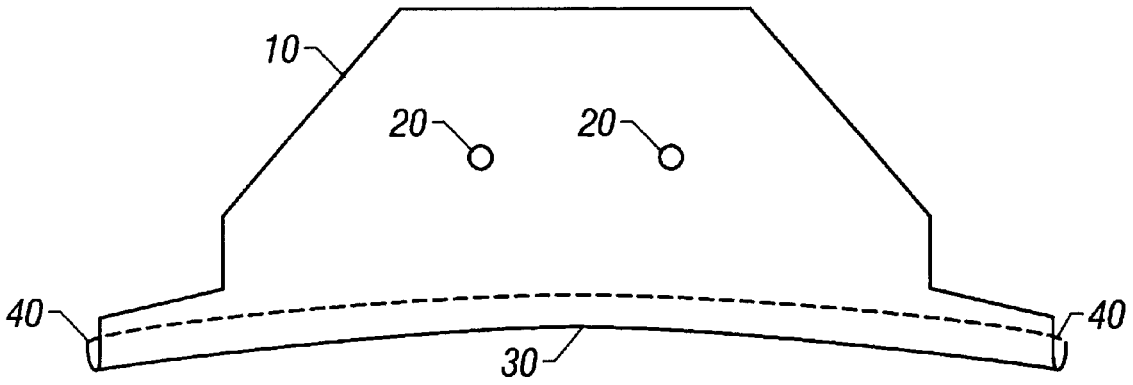
FIG. 1 shows a rear view of one embodiment of the rain guard.
Figure 2:
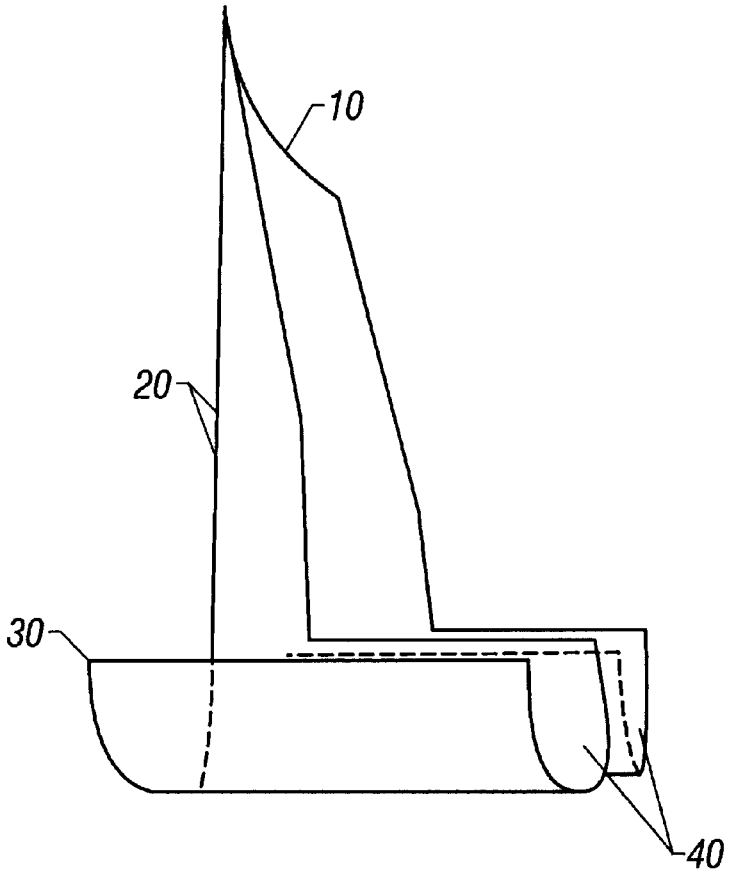
FIG. 2 shows a side view of the embodiment shown in FIG. 1.
Figure 3:
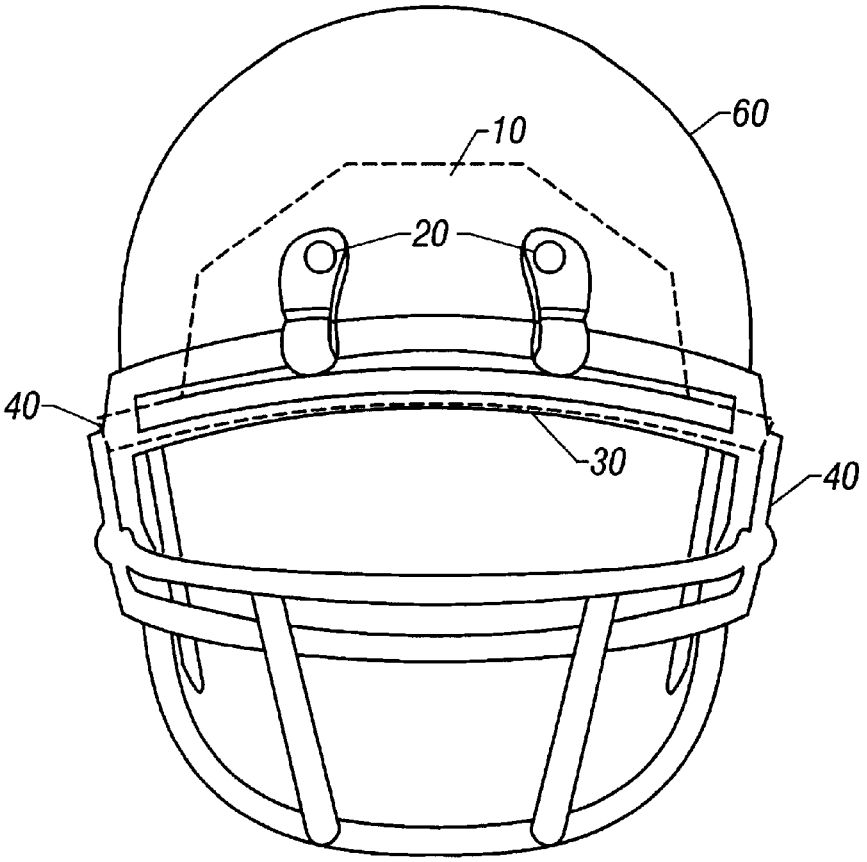
FIG. 3 shows the embodiment of FIG. 2 attached to a football helmet.

FIGS. 1, 2 and 3—Preferred Embodiment

A preferred embodiment of the rain guard is illustrated in FIG. 1 (rear view) and FIG. 2 (side view) and the preferred embodiment of the attachment of the rain guard is illustrated in FIG. 3 (front view).

In the preferred embodiment, the rain guard is a flexible plastic, such as poly-ethylene-tere-phthalate (PET-hyphens here supplied to facilitate pronunciation) available from Eastman Chemical Co. of Kingsport, Tenn. However, the base can consist of any other material that can be repeatedly bent without fracturing, such as polyethylene, polypropylene, vinyl, nylon, rubber or various plasticized materials etc.

The rain guard has a thin attachment base 10 curved to conform to the interior of a helmet (60 in FIG. 3). Attachment holes 20 align with corresponding attachment holes in the helmet (60 in FIG. 3) a curved lip 30 is shaped as a rounded channel. Water is collected in the curved lip 30 and exits via the water exits 40 positioned at the side of the helmet outside of the helmet wearer's vision.

The rain guard is typically sized to fit a traditional football helmet. The rain guard is roughly 0.8 mm to 1.2 mm in thickness and has overall dimensions roughly 80 mm tall and 240 mm from water exit to water exit 40. The curved lip 30 is approximately 10 mm by 10 mm.

Figure 4:
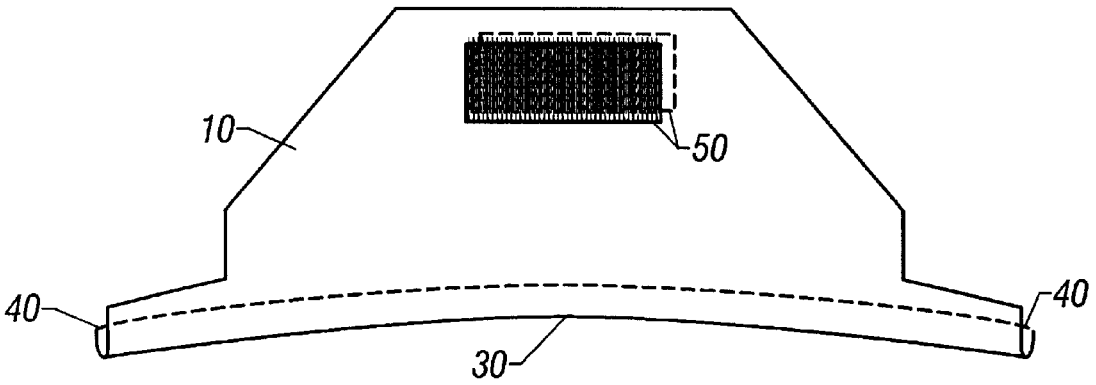
FIG. 4 shows a rear view of one embodiment of the rain guard including part of a hook and loop fastener to attach the guard to a football helmet.

FIG. 4—Additional Embodiments

An additional embodiment is shown in FIG. 4. The rear view of the rain guard is shown with a hook and loop fastener 50 for attachment to the helmet (60 in FIG. 3). Any other attachment device such as double sided tape or adhesive that allows for quick removal or attachment of the rain guard to the interior of the helmet will suffice.

Advantages

From the description above, a number of advantages of the rain guard become evident:

(a) the rain guard will greatly diminish or eliminate water flowing off of the front of a football helmet into a wearer's face.

(b) the rain guard can be transparent to allow the wearer a full range of vision.

(c) the rain guard will add minimal weight to the football helmet.

(d) the rain guard will help make a safer football helmet by providing for clearer vision during a rainy football game.

Operation—1,2,3,4

The manner of using the rain guard is to remove top two screws such as would be inserted through holes 20 attaching the facemask to the helmet, although the facemask does not have to be removed. A forehead pad that is attached via hook and loop fasteners will be removed to allow for access to nuts that hold the top of the facemask. The base of the rain guard 10 is then matched to the two holes in the helmet and the facemask is reattached. If hook and loop connectors are used to attach the rain guard then there is no need to loosen the top two facemask screws. The forehead pad is simply removed and the rain guard is positioned into the area where the facemask nuts are located. The forehead pad is then reattached.

Conclusion, Ramifications, and Scope

Accordingly, the reader will see that this invention can be used to provide improved visibility for the wearer of a football helmet during a rainy game. In addition, the rain guard can be attached by temporary means so that it can be easily removed or replaced during a game, as weather requires. Furthermore, the rain guard attachment has the additional advantages in that it permits a safer football helmet with very minimal additional weight;

it permits a safer football helmet with very little additional cost to the manufacturer;

it allows for the rain guard to be of clear material to minimally effect the wearer's vision;

Although the description above contains many specifications, these should not be construed as a limiting the scope of the invention but as merely providing illustrations of some of the presently preferred embodiments of this invention. For example, the rain guard could be made with the forehead pad of the helmet attached such that they are one piece. This would facilitate easier removal and replacement of the rain guard. Likewise, the attachment could be connected to the facemask itself, again to facilitate easier removal or replacement.

I claim:

1. A rain guard for a football helmet, comprising:

an attachment section formed to conform to a contour of an interior front face of the helmet;

a curved lip coupled to the attachment section and shaped to conform to an outer front face edge of the helmet, the curved lip shaped to collect moisture, the curved lip having a water outlet thereon positioned away from a face of a wearer donning the helmet.

2. The rain guard as defined in claim 1 wherein the attachment section is adapted to be affixed to the interior face of the helmet by screws.

3. The rain guard as defined in claim 1 wherein the attachment section is adapted to be affixed to the interior face of the helmet by a hook and loop fastener.

4. The rain guard as defined in claim 1 wherein the attachment section, the curved lip and the water outlet are formed as a single member.

* * * * *

UNITED STATES PATENT AND TRADEMARK OFFICE

CERTIFICATE OF CORRECTION

PATENT NO. : 6,151,719

DATED : November 28, 2000

INVENTOR(S) : Greg Poole

It is certified that error appears in the above-identified patent and that said Letters Patent are hereby corrected as shown below:

Column 2, line 52, insert --.-- after "FIG 3)', and change "a" to --A--.

Column 3, line 21, insert --first embodiment of the-- after "using the".

Signed and Sealed this

Eighth Day of May, 2001

*Attest:*

Nicholas P. Godici

NICHOLAS P. GODICI

*Attesting Officer*

*Acting Director of the United States Patent and Trademark Office*